United States Patent [19]

Rohrbach

[11] 4,111,153

[45] Sep. 5, 1978

[54] ADHESIVE DISPENSING APPARATUS FOR CARD TIPPER

[75] Inventor: Peter H. Rohrbach, Bethlehem, Pa.

[73] Assignee: Harris Corporation, Cleveland, Ohio

[21] Appl. No.: 842,000

[22] Filed: Oct. 14, 1977

[51] Int. Cl.[2] ..... B05C 11/00

[52] U.S. Cl. ..... 118/7; 156/357; 156/568; 427/288

[58] Field of Search ..... 118/2, 3, 6, 7; 156/291, 357, 578, 567, 568, DIG. 34; 427/285, 288

[56] References Cited

U.S. PATENT DOCUMENTS

| | | | |
|---|---|---|---|
| 3,249,483 | 5/1966 | Kauffman et al. | 156/567 X |
| 3,347,205 | 10/1967 | Dobbyn | 118/7 |
| 3,751,324 | 8/1973 | Enskat | 156/578 X |
| 3,768,439 | 10/1973 | Schweitzer | 118/2 X |
| 3,772,123 | 11/1973 | Clark et al. | 156/357 |
| 3,858,869 | 1/1975 | Campbell | 156/568 |

*Primary Examiner*—Mervin Stein

[57] ABSTRACT

Apparatus for applying adhesive onto cards or other inserts to be adhered to signatures on a collecting conveyor. A solenoid valve controlled dispensing nozzle is energized when a card is detected by photodetectors as being in proper position for receiving adhesive. Two sets of photodetectors may be employed and positioned for high and low speeds, respectively. A chopper may be introduced into the energization path of the solenoid valve at low speeds to reduce the amount of adhesive deposited.

12 Claims, 5 Drawing Figures

FIG. 3
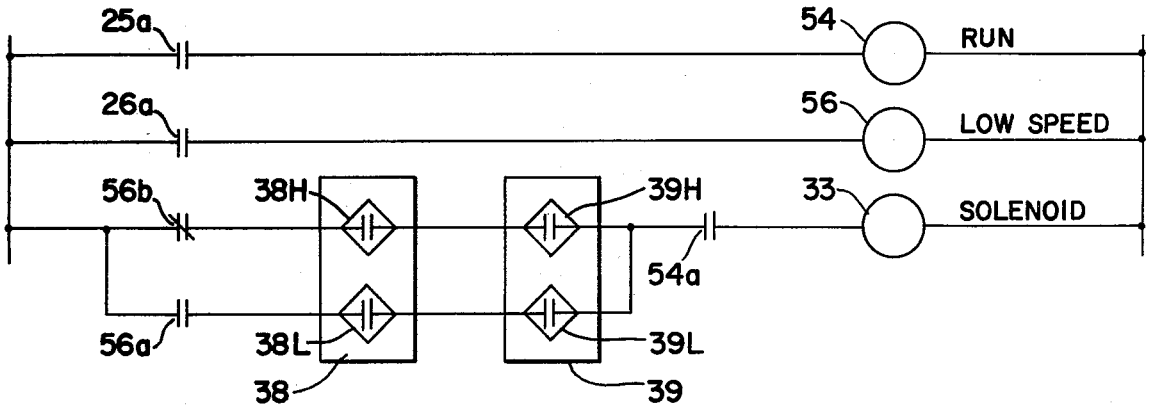
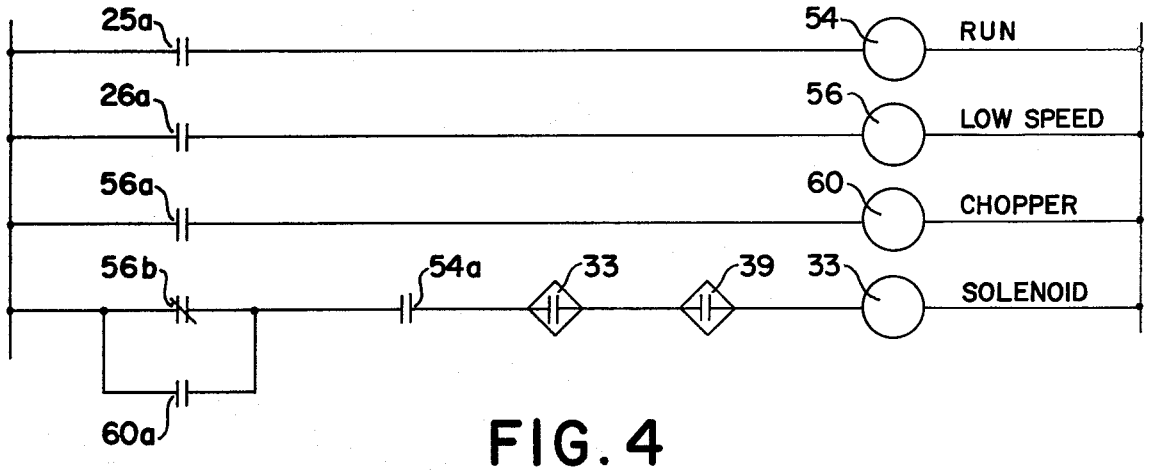
FIG. 4
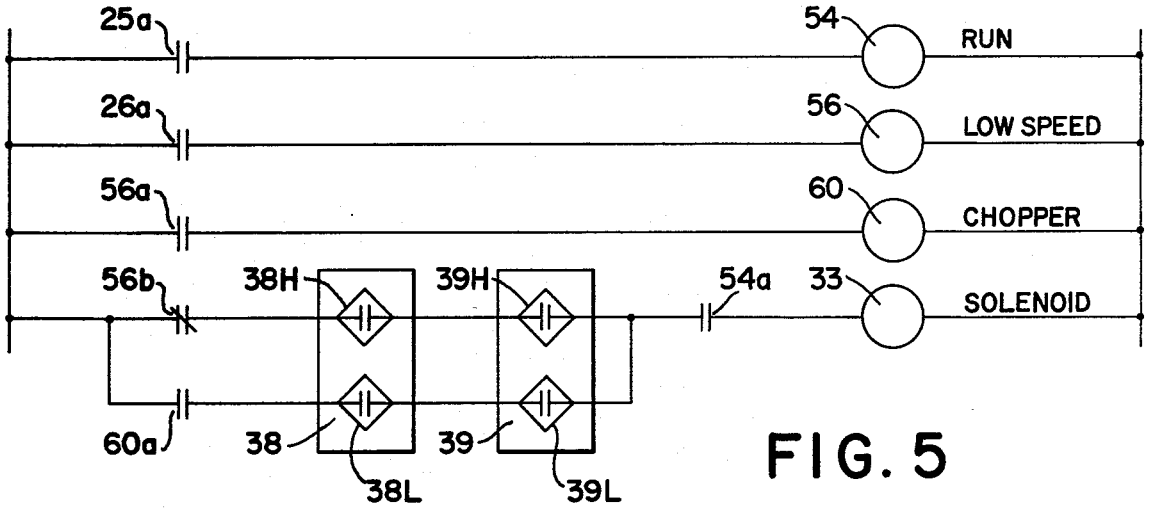
FIG. 5

ADHESIVE DISPENSING APPARATUS FOR CARD TIPPER

BACKGROUND OF THE INVENTION

This invention relates to adhesive applying apparatus and more particularly to apparatus for applying adhesive to cards or other inserts which are to be adhered to a page or signature of a magazine, periodical or the like.

In the binding of relatively thin books and periodicals it is common to adhesively attach, or tip, an insert such as a card to a page of a signature which is to be part of the book. Typically, the cards or other inserts are fed onto a conveyor where the cards are adhered to signatures on the conveyor. The path of a card in its travel from a storage means such as a tray to the conveyor is through an adhesive applying station. Adhesive can be applied to the card by various methods. One method which has been found to be of advantage employs one or more solenoid operated dispensing nozzles which apply a thin strip of adhesive to one or more edges of the card as the card moves past the nozzle.

A problem associated with the use of such dispensing nozzles, however, has been in controlling the dispensing of adhesive to provide a desired pattern and amount at different speeds of travel of the card. It is desirable to apply a substantially uniform amount of adhesive to each card at all speeds of travel and also to control the application so that the adhesive strip terminates a desired distance from both the leading and trailing edges of the card.

SUMMARY OF THE INVENTION

A general object of this invention is to provide adhesive dispensing apparatus for card tipping which overcomes the disadvantages mentioned above encountered with prior systems.

A more particular object is to provide adhesive applying apparatus for a card tipper which automatically applies desired uniform amounts of adhesive at the proper position to cards passing the apparatus at different speeds.

Briefly, the present invention provides apparatus for applying adhesive to a card or other insert including adhesive dispensing means and means for moving a card in a path past the adhesive dispensing means. First and second detector means are positioned adjacent the dispensing means for providing signals when the card is in a predetermined position with respect to the adhesive dispensing means. Means are provided for determining the speed of travel of the card, and means are provided responsive to signals from the detector means for energizing the adhesive dispensing means.

According to one aspect of the present invention the first detector means provides signals when the card is in a first position and the second detector means provides signals when the card is in a second position. Means are provided responsive to the speed of travel of the card for selecting signals from one of the detector means at speeds above a predetermined speed and for selecting signals from the other detector means at speeds below the predetermined speed.

According to another aspect of the present invention, means are provided responsive to the speed of travel of the card below a predetermined speed for periodically interrupting energization of the dispensing means during the passage of the card past the detector means.

BRIEF DESCRIPTION OF THE DRAWINGS

FIG. 3 is schematic diagram of a control system for adhesive applying apparatus embodying the present invention.

FIG. 4 is a schematic diagram of a control system for adhesive applying apparatus embodying another aspect of the present invention.

FIG. 5 is a schematic diagram of a control system for adhesive applying apparatus embodying the aspects of FIGS. 3 and 4 combined.

DESCRIPTION OF A PREFERRED EMBODIMENT

Figure 1:
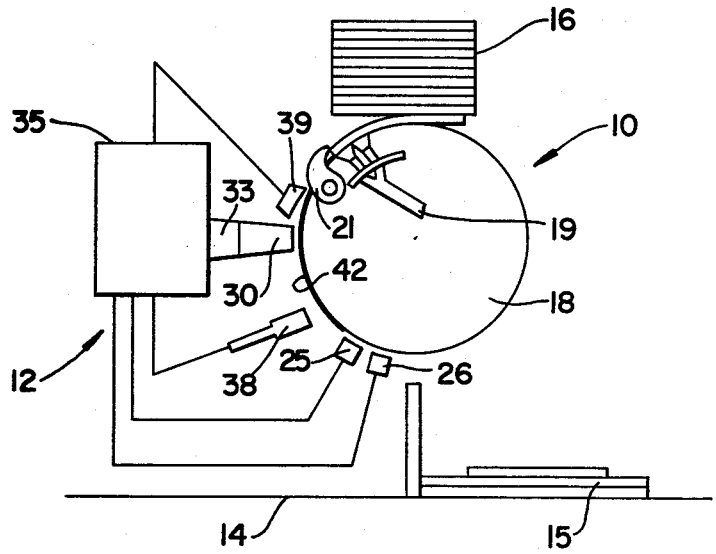
FIG. 1 is a side elevational view of adhesive applying apparatus embodying the present invention associated with a card feeder.

As shown in FIG. 1, a card feeding mechanism generally designated 10 directs cards C past an adhesive applying apparatus 12 and onto a conveyor 14 where the cards are adhered or tipped onto signatures 15 passing along the conveyor. Card feeder 10 includes a tray 16 for storage of cards C and a rotating drum 18. Drum 18 rotates in timed relation to movement of conveyor 14 as is well known. The lowermost card C in tray 16 is moved downwardly by a sucker member 19 into a position where the edge of the card can be gripped by a gripper 21 carried drum 18. The gripper 21 carries the card around the drum and drops it into a chain space on conveyor 14 on top of a signature therein. The speed of conveyor 14 and of drum 18 is adjustable as, for example, for high and low speeds. A plurality of speed detector switches, two being shown and identified as 25 and 26, are provided for indicating the speed of drum 18. Switch 25 is actuated when gripper drum 18 is in motion. Switch 26 is actuated when the drum is operating at low speed. The switches are adjustable to operate at predetermined detected speeds. Switches 25 and 26 are preferably those manufactured by Winterburn Manufacturing Company of Putnam, Conn. and identified as a Dazic Speed Switch.

Adhesive dispensing apparatus 12 includes a dispensing nozzle 30 which is controlled by a solenoid actuated valve 33. Nozzle 30 dispenses adhesive from a supply (not shown) onto a card C when solenoid valve 33 is energized. The solenoid valve is energized by a signal from an adhesive control system 35 when a card C is in the proper position in its path of travel to conveyor 14 for the application of a strip of adhesive thereto. The control signal to solenoid valve 33 is issued when photodetector relays 38, 39 have each provided a signal to control system 35 indicating that a card is in the proper position to receive a strip of adhesive. Photodectors 38 and 39 are aimed at a strip of reflective tape 42 provided on drum 18. Detectors 38 and 39 are actuated when a card passing to conveyor 14 interrupts the light path between reflective tape 42 and the respective detector.

Figure 2:
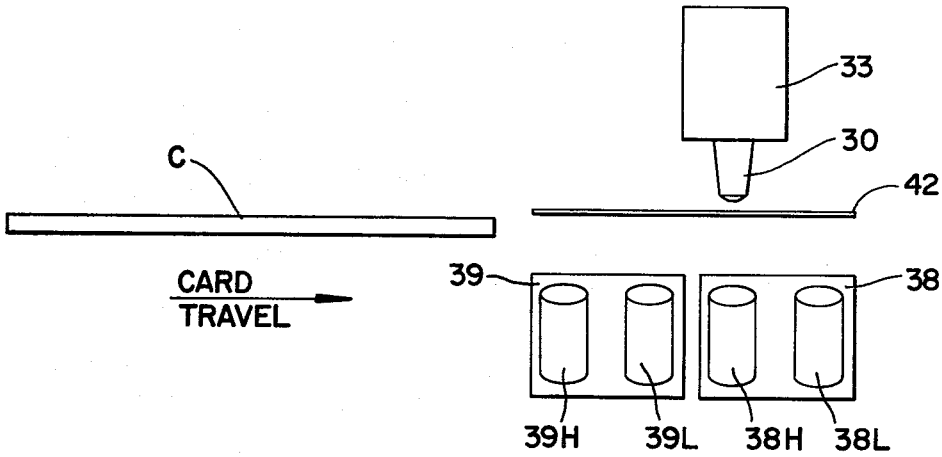
FIG. 2 is a diagram illustrating the arrangement of the parts of adhesive applying apparatus embodying the present invention.

FIGS. 2 and 3 illustrate the control aspects of the system and will be referred to for a detailed description of operation. It will be appreciated that dispensing nozzle 33 and photodetectors 38 and 39 are actually on the same side of card C rather than on opposite sides as depicted diagrammatically in FIG. 2.

As seen in FIG. 2, according to an aspect of the present invention, each of detectors 38 and 39 includes a detector 38H, 39H for high speed use and a detector 38L and 39L for low speed use. At high speed only detectors 38H, 39H are operative while at low speed only detectors 38L, 39L are operative. Considering high speed operation initially, as card C approaches dispensing nozzle 30 it first interrupts light reflected to photodetector 39H and that photodetector is activated. When the card reaches photodetector 38H and the light path to both photodetectors is interrupted a signal is transmitted by control system 35 to energize solenoid valve 33. Solenoid 33 remains energized so long as both detectors 38H and 39H are "dark". When the trailing edge of card C passes photodetector 39H the signal to solenoid 33 is interrupted.

Detectors 38H and 39H are spaced a distance apart corresponding to twice the distance traveled by card C at high speed during the turn-on or turn-off times of solenoid valve 33 which are assumed to be equal. Accordingly, the strip of adhesive on card C will begin a distance from the leading edge corresponding to one half of the distance between photodetectors 38H and 39H and will end a corresponding distance from the trailing edge of the card.

If the same set of photodectors 38H, 39H were employed at lower speeds of card travel the adhesive strip on card C would begin closer to the leading edge of the card and terminate farther from the trailing edge of the card.

To overcome this problem the second set of photodetectors 38L, 39L is positioned downstream of the high speed photodetectors 38H and 39H and is employed for low speed operation. Thus, solenoid valve 33 is actuated only when light to both photodetectors 38L and 39L is blocked by card C. As a result, solenoid valve 33 is actuated later and turned off later than by photodetectors 38H and 39H. The adhesive strip on card C is, therefore, positioned farther away from the leading edge of card C and closer to the trailing edge resulting in a more symmetrical strip of adhesive.

FIG. 3 illustrates the control system for the arrangement shown in FIG. 2. Contact 25*a* of motion speed detection switch 25 (FIG. 1) closes when drum 18 is rotating and actuates run relay 54. A low speed relay 56 has a normally open contact 56*a* in series with the contacts of photodectors 38L and 39L in the actuation path of solenoid valve 33. A normally closed contact 56*b* is in series with the contacts of photodetectors 38H and 39H in an alternate actuation path. Contact 54*a* of run relay 54 is also in the actuation path of solenoid valve 33. At high speed run relay 54 is actuated and low speed relay 56 is not actuated. In that case, solenoid valve 33 will be energized through contact 56*b* and contacts 38H, 39H as well as run relay contact 54*a* when a card is detected by photodetectors 38H, 39H. At low speed, low speed switch 26 will be actuated and energize low speed relay 56 through contacts 26*a*. In that case, solenoid valve 33 will be energized through contact 56*a* and 54*a* along with the contacts of photodetectors 38L and 39L when the latter photodetectors sense a card C in the proper position.

Another problem associated with low speed operation is the deposit of an excessive amount of adhesive on card C. Another aspect of the present invention resolves this problem by insertion of a "chopper" in the path of energization of solenoid valve 33 at low speed. The chopper, when energized, opens and closes its contacts at a desired rate and duty cycle. Solenoid valve 33 is, therefore, also energized and deenergized at the same rate and duty cycle. The result is a series of dots of adhesive deposited upon card C rather than one continuous strip. A control system employing such a chopper with a single set of photodetectors, identified as 38 and 39, is shown in FIG. 4.

The control system of FIG. 4 includes run relay 54 and low speed relay 56 which are actuated as described above in connection with FIG. 3. Chopper 60 is energized by contact 56*a* at low speed. In high speed operation, solenoid valve 33 is energized through normally closed contact 56*b* and the contacts of photodetectors 38 and 39 when a card C is sensed as being in the proper position for depositing adhesive thereon. At low speed, relay 56 is actuated along with chopper 60. Solenoid valve 33 is then actuated periodically through chopper contacts 60*a* so that dots rather than a continuous strip of adhesive are deposited upon card C.

The control systems shown in FIGS. 3 and 4 featuring, respectively, a chopper and two sets of photodetectors may be combined into a single system. Such a control system is shown in FIG. 5.

In the system of FIG. 5, run relay 54 and low speed relay 56 are again actuated by motion detector switch 25 and low speed detector switch 26, respectively. Chopper 60 is actuated by low speed relay contact 56*a*. At high speed, run relay 54 is actuated but neither low speed relay 56 nor chopper 60 is energized. Solenoid valve 33 is energized through normally closed contact 56*b* of low speed relay 56 and contact 54*a* of run relay 54 as well as the contacts of photodetectors 38H and 39H. At low speed, solenoid valve 33 is energized through chopper contact 60*a* and the contacts of photodetectors 38L and 39L. As a result, adhesive will be applied to card C in dots rather than in a continuous strip. The deposit will also be substantially the desired distance from the leading and trailing edges of card C as described above.

If desired, where conveyor 14 and drum 18 are operable at more than two speeds, the second set of detectors 38L and 39L and the chopper 60 may be introduced into the control system at different speeds. This requires an additional speed detector switch such as switch 26 adjusted to detect a lower speed of operation. The second photodetector set 38L, 39L may be introduced when one speed detector switch is operated at a certain speed while the chopper may be introduced separately at a still lower speed as a result of actuation of another speed detector switch.

While a preferred form and embodiment of this invention has been disclosed herein, it will be apparent to those skilled in the art that other forms and embodiments may be employed without departing from the essential principles of the invention. Accordingly, this invention is not to be limited by the specific embodiments disclosed herein nor in any other way inconsistent with the progress in the art promoted by this invention.

What is claimed is:

1. Apparatus for applying adhesive to a card or other insert to be adhered to a signature comprising adhesive dispensing means, means for moving said card in a path past said adhesive dispensing means, first card detector means positioned adjacent said dispensing means, second card detector means spaced from said first detector means, means for providing a signal to actuate said dispensing means when said card is detected by both said detector means, means for determining the speed of travel of said card in said path, and means responsive to a speed of travel of said card below a predetermined speed for periodically interrupting the actuation of said dispensing means during the passage of said card, whereby said card receives dots of adhesive from said dispensing means.

2. Apparatus as claimed in claim 1 wherein said adhesive dispensing means includes a solenoid actuated valve.

3. Apparatus as claimed in claim 2 wherein said periodic interrupting means includes a chopper in the path of actuation of said solenoid actuated valve.

4. Apparatus as claimed in claim 1 wherein said first and second detector means comprise photodetectors on one side of said path and a reflective surface on the opposite side of said path.

5. Apparatus as claimed in claim 1 wherein said card moving means comprises a rotating drum and gripper means carried by said drum for gripping said card and moving it in said path past said adhesive dispensing means.

6. Apparatus as claimed in claim 1 wherein said first and second detector means are positioned with respect to said dispensing means such that adhesive applied to said card begins a predetermined distance from the leading edge of said card and terminates a predetermined distance from the trailing edge of said card.

7. Apparatus for applying adhesive to a card or other insert to be adhered to a signature comprising adhesive dispensing means, means for moving said card in a path past said adhesive dispensing means, first detector means adjacent said adhesive dispensing means for providing a signal when said card is in a first position with respect to said adhesive dispensing means, second detector means adjacent said adhesive dispensing means for providing a signal when said card is in a second position with respect to said adhesive dispensing means, means for determining the speed of travel of said card in said path, means responsive to the speed of travel of said card for selecting a signal from one of said detector means at speeds above a predetermined speed and for selecting a signal from the other detector means at speeds below said predetermined speed, and means responsive to said selected signals from one or the other of said detector means for energizing said adhesive dispensing means.

8. Apparatus as claimed in claim 7 wherein each of said detector means includes a first photodetector relay positioned behind said adhesive dispensing means in the direction of card travel and a second photodetector relay positioned ahead of said first photodetector relay in the direction of card travel, said photodetector relays being positioned to cause adhesive to be applied on said card at desired positions according to the speed of travel of said card.

9. Apparatus as claimed in claim 7 wherein said adhesive dispensing means is energized only when said card is detected by both of said first and second photodetector relays.

10. Apparatus as claimed in claim 8 wherein said adhesive dispensing means includes a solenoid controlled valve, said means for determining the speed of travel of said card in said path includes a speed responsive switch, and wherein said means for selecting signals from one of said detector means includes a first contact of said speed responsive switch in series with the contacts of said first and second photodetector relays of said first detector means and a second contact of said speed responsive switch in series with the contacts of said first and second photodetector relays of said second detector means, all of said contacts being in the path of actuation of said solenoid actuated valve.

11. Apparatus as claimed in claim 7 further comprising means responsive to the speed of travel of said card below a predetermined speed for periodically interrupting the energization of said dispensing means during the passage of said card past said other detector means.

12. Apparatus as claimed in claim 11 wherein said interrupting means includes a chopper in the energization path of said adhesive dispensing means.

* * * * *